US005678766A

United States Patent [19]

Peck et al.

[11] Patent Number: 5,678,766

[45] Date of Patent: Oct. 21, 1997

[54] FOAM NOZZLE

[76] Inventors: William E. Peck, 6801 Camden, Ste. 12, Groves, Tex. 77619; Larry G. Locke, 9221 Northridge, Orange, Tex. 77632

[21] Appl. No.: 504,367

[22] Filed: Jul. 19, 1995

[51] Int. Cl.[6] ..... B05B 7/30; B05B 7/04

[52] U.S. Cl. ..... 239/419; 239/424

[58] Field of Search ..... 239/423, 424, 239/424.5, 416.5, 417, 416.4, 499, 456, 419; 169/14, 15; 279/343

[56] References Cited

U.S. PATENT DOCUMENTS

| | | | |
|---|---|---|---|
| 1,561,848 | 11/1925 | Green | 239/417 |
| 2,538,949 | 1/1951 | Richards . | |
| 2,643,916 | 6/1953 | White et al. | 239/416.5 |
| 2,832,424 | 4/1958 | Hurst | 169/15 X |
| 3,265,313 | 8/1966 | Paris . | |
| 3,301,485 | 1/1967 | Tropeano et al. | 169/15 X |
| 3,693,884 | 9/1972 | Snodgrass et al. . | |
| 3,782,884 | 1/1974 | Shumaker | 239/424 X |
| 3,799,403 | 3/1974 | Probst et al. . | |
| 4,103,827 | 8/1978 | Kumazawa | 239/499 X |
| 4,497,442 | 2/1985 | Williams . | |
| 4,640,461 | 2/1987 | Williams . | |
| 5,054,688 | 10/1991 | Grindley . | |
| 5,277,256 | 1/1994 | Bailey . | |
| 5,312,041 | 5/1994 | Williams et al. | 169/14 X |
| 5,330,105 | 7/1994 | Kaylor . | |

FOREIGN PATENT DOCUMENTS

| | | | |
|---|---|---|---|
| 2 302 789 | 10/1976 | France . | |
| 2203065 | 10/1988 | United Kingdom | 239/424 |
| WO 81/03129 | 11/1981 | WIPO . | |
| WO 90/08456 | 8/1990 | WIPO . | |

*Primary Examiner*—Kevin Weldon
*Attorney, Agent, or Firm*—Richard C. Litman

[57] ABSTRACT

A firefighting nozzle for discharging a foam and water mixture. The firefighting nozzle has an inner nozzle concentrically positioned within an outer barrel. A baffle in the shape of an inverted cone is position at the outlet of the inner nozzle. The axial position of the baffle determines the flow rate of the foaming agent. The inner nozzle itself is also axially movable within the bore of the outer barrel, the axial position of the inner nozzle determining the flow rate of water between the outer barrel and the inner nozzle.

8 Claims, 2 Drawing Sheets

FOAM NOZZLE

BACKGROUND OF THE INVENTION

1. Field of the Invention

The present invention relates to a nozzle for directing firefighting foam mixtures at a fire.

2. Description of the Prior Art

In large fires water alone is often inadequate for extinguishing the fire. Water and fire extinguishing foam mixtures have been developed that have been found to have much enhanced fire extinguishing capability compared to plain water. Such fire extinguishing foams require specialized mixing nozzles for their application. Many mixing nozzles have been proposed in the prior art, however none is seen to show the axially movable inner foam nozzle of the present invention or the inverted cone-shaped baffle used in the present invention.

U.S. Pat. No. 2,538,948, issued to Richards, shows a mixing nozzle for spraying a mixture of agricultural chemicals and water. Richards does not show the axially movable inner nozzle of the present invention.

U.S. Pat. No. 3,265,313, issued to Paris, shows a mixing nozzle for mixing two fluid streams. Paris does not show the axially movable inner nozzle or the cone-shaped baffle of the present invention.

U.S. Pat. No. 3,693,884, issued to Snodgrass et al., shows a firefighting nozzle for applying a firefighting foam. Snodgrass et al. do not show the axially movable inner nozzle of the present invention.

U.S. Pat. No. 3,799,403, issued to Probst et al., shows a mixing nozzle for mixing several liquid streams. The nozzle of Probst et al. lacks the axially movable inner nozzle or the cone-shaped baffle of the present invention.

U.S. Pat. No. 4,497,442, issued to Williams, and U.S. Pat. No. 4,640,461, also issued to Williams, show firefighting nozzles for applying a firefighting foam. The nozzles of Williams lack the axially movable inner nozzle or the cone-shaped baffle of the present invention.

U.S. Pat. No. 5,054,688, issued to Grindley, shows a nozzle for aerating a pressurized liquid stream. The nozzle of Grindley lacks the axially movable inner nozzle or the cone-shaped baffle of the present invention.

U.S. Pat. No. 5,277,256, issued to Bailey, shows a firefighting nozzle for applying a firefighting foam. The nozzle of Bailey lacks the axially movable inner nozzle or the cone-shaped baffle of the present invention.

U.S. Pat. No. 5,330,105, issued to Kaylor, shows a nozzle for mixing air with a liquid stream. Kaylor does not show the axially movable inner nozzle or the cone-shaped baffle of the present invention.

French Patent Document Number 2 302 789, published on Oct. 1, 1976, shows a mixing nozzle. French Document '789 does not show the axially movable inner nozzle or the cone-shaped baffle of the present invention.

International Patent Document Number WO 81/03129, by Hull, shows a mixing device for generating a cleaning foam. Hull does not show the axially movable inner nozzle or the cone-shaped baffle of the present invention.

International Patent Document Number WO 90/08456, by Norman, shows a spray nozzle for mixing a cleaning agent with a water stream. Norman does not show the axially movable inner nozzle or the cone-shaped baffle of the present invention.

None of the above inventions and patents, taken either singly or in combination, is seen to describe the instant invention as claimed.

SUMMARY OF THE INVENTION

The present invention is directed to a firefighting nozzle assembly for discharging a foam and water mixture. The firefighting nozzle assembly has an inner nozzle concentrically positioned within an outer barrel. A baffle in the shape of an inverted cone is position at the outlet of the inner nozzle. The axial position of the baffle determines the flow rate of the foaming agent. The inner nozzle itself is also axially movable within the bore of the outer barrel, the axial position of the inner nozzle determining the flow rate of water between the outer barrel and the inner nozzle.

Accordingly, it is a principal object of the invention to provide a firefighting nozzle allowing for independent selection of the water flow rate and the foaming agent flow rate.

It is another object of the invention to provide a firefighting nozzle which allows the discharge of either a diffuse or a concentrated fire-extinguishing liquid stream.

It is a further object of the invention to provide a fire fighting nozzle wherein the axial position of an inner nozzle determines the water flow rate through the firefighting nozzle.

Still another object of the invention is to provide a firefighting nozzle wherein the axial position of a cone shaped baffle within an inner nozzle determines the flow rate of foaming agent through the firefighting nozzle.

Yet another object of the invention is to provide a firefighting nozzle wherein vanes provided on the surface of a cone shaped baffle enhance the mixing of foaming agent and water.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
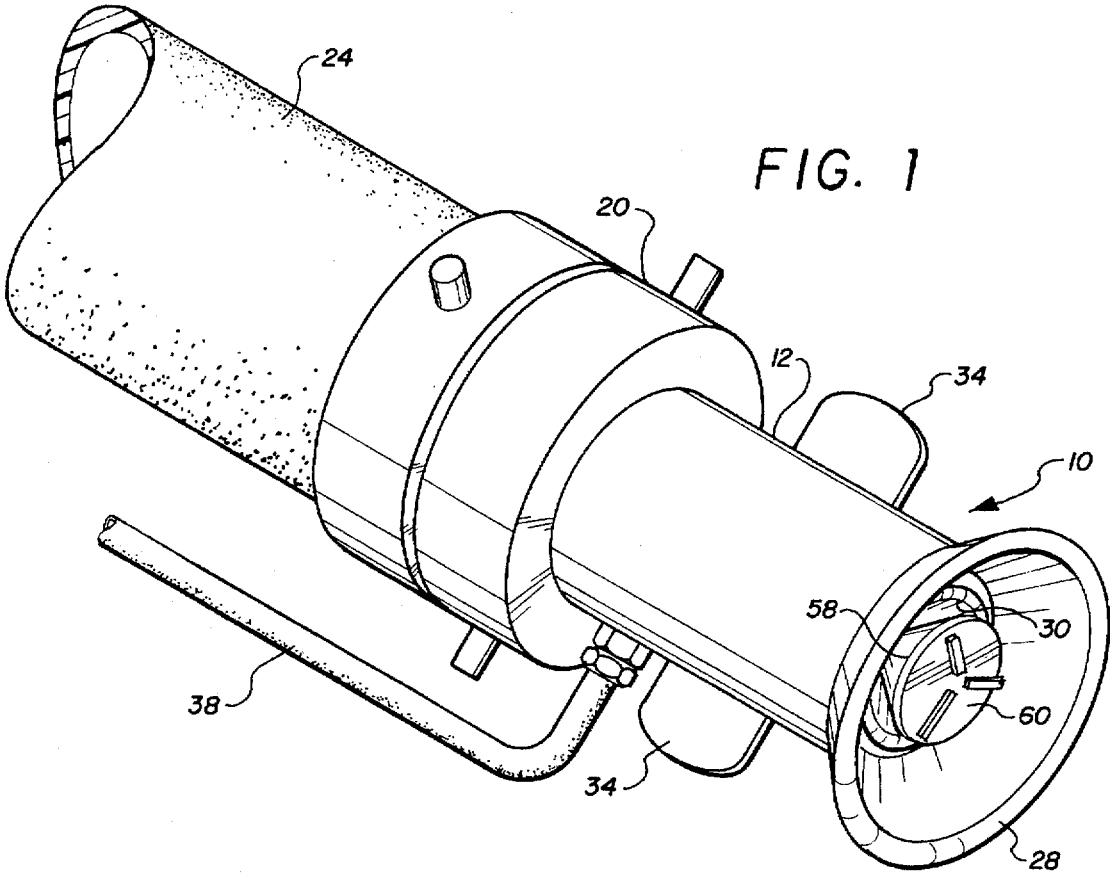
FIG. 1 is an environmental perspective view showing the nozzle of the present invention attached to a fire hose.
Figure 2:
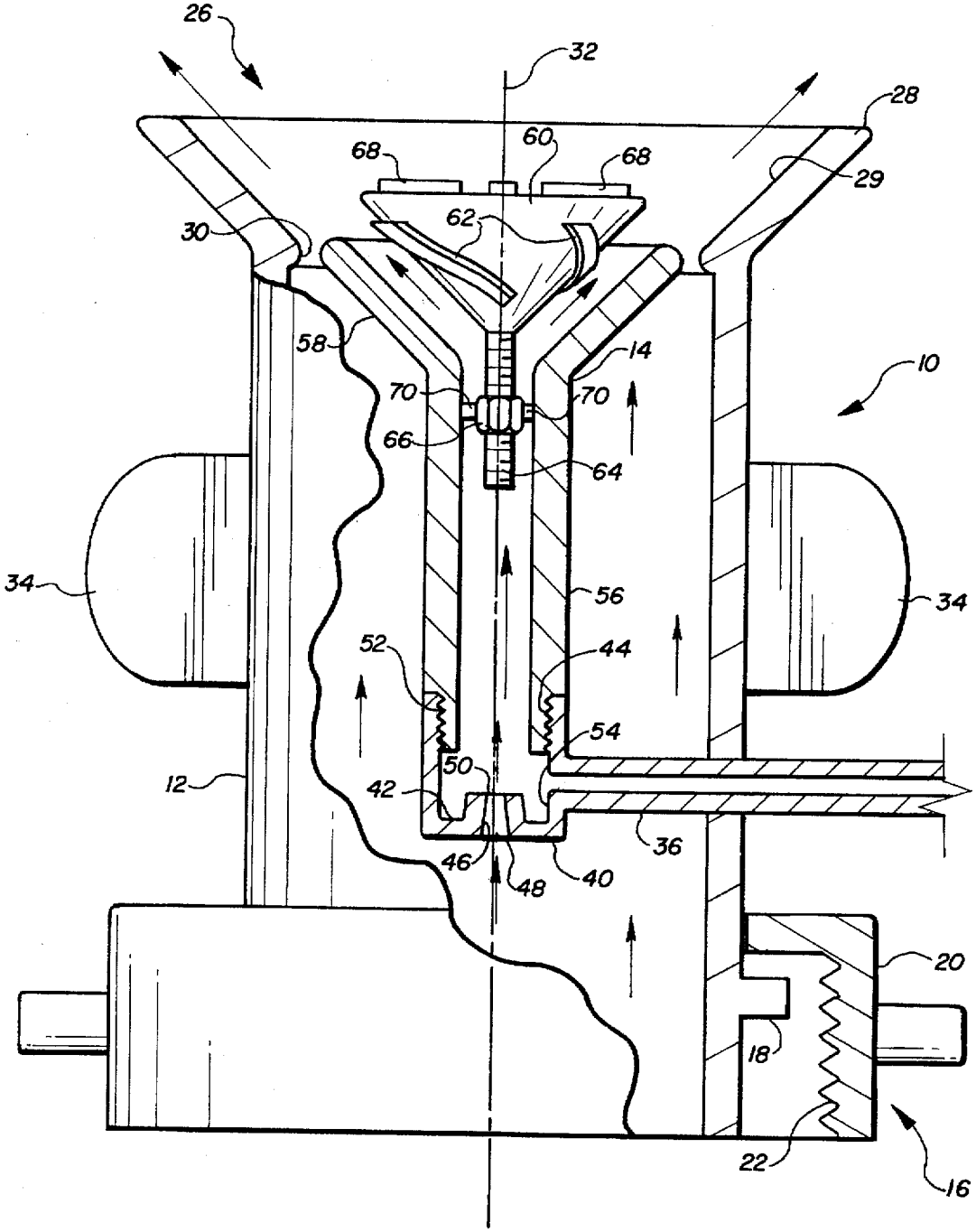
FIG. 2 is a cross sectional view showing the nozzle of the present invention.

Referring to FIGS. 1 and 2, the present invention is a nozzle assembly 10, including an outer barrel 12 and an inner foam nozzle 14. The assembly has a standard attachment system 16 for attaching nozzle 10 to a standard fire hose. The attachment system 16 includes a flange 18 and a threaded collar 20. The threaded collar has female threads 22 which matingly engage the male threads (not shown) provided at the end of the standard fire hose 24. With the collar 20 tightened down on the threaded end of the fire hose 24, the flange 18 is squeezed between the collar 20 and the threaded end of the hose 24, thereby creating a liquid tight connection between the hose 24 and nozzle assembly 10.

The outer barrel 12 is cylindrical and has a discharge opening or end 26. The discharge end 26 has an annular rim 28 flaring outward from the perimeter of the discharge opening. Rim 28 directs the water/foam mixture flow when the nozzle 10 is in the wide spray mode. The front surface 29 of the rim 28 is inclined relative to the direction perpendicular to the longitudinal axis 32 of the barrel 12. Projecting inward from the perimeter of discharge opening 26, is a lip 30. The size of the annular gap between lip 30 and the funnel shaped portion of the foam nozzle 14 controls the flow rate of water through the nozzle 10. Barrel 12 further has wings 34 projecting from its outside surface. The wings 34 allow the nozzle 10 to be more easily grasped and controlled by a firefighter during high pressure discharge. In addition, wings 34 allow the barrel 12 to be more easily held stationary while unscrewing or tightening the collar 20.

Passing through the side wall of the barrel 12 is a foam inlet conduit 36, which is in fluid communication with foam or foaming agent supply line 38. Conduit 36 extends radially inward within the barrel 12 to approximately the centerline 32 of the barrel 12. At about the center line 32 the conduit 36 supports the foam nozzle base 40. Foam nozzle base 40 is cup shaped and has an interior cavity extending between its bottom 42 and its threaded open top 44. An inlet nozzle 46 is centrally located in the base bottom 42. Nozzle 46 tapers from a wide inlet opening 48 to a narrow discharge end 50. Conduit 36 is in fluid communication with the interior cavity of the foam nozzle base 40 through the sidewall 54 of the base 40. Optionally, support struts (not shown) extending radially between barrel 12 and the base 40, can be provided to add further support to the base 40.

Foam nozzle 14 has male threads 52 which matingly engage the female threads at the open top 44 of the base 40 to fasten the foam nozzle 14 to the base 40. The foam nozzle 14 has an elongated cylindrical portion 56 extending between the end having male threads 52 and the narrow end of the funnel shaped portion 58. The cylindrical portion 56 has a through bore in registry with nozzle 46, which extends along the length of the cylindrical portion 56. Funnel shaped portion 58 has a tapering channel extending between its narrow end and its wide end. An inverted cone shaped baffle 60 is positioned at the wide end of funnel shaped portion 58 so as to lie at least in part within the funnel shaped portion 58. Baffle 60 acts to direct the foaming agent issuing from nozzle 14 away from center line 32 and into the water stream issuing from the annular gap between lip 30 and the funnel shaped portion 58, thereby enhancing the mixing of the foaming agent and the water.

Vanes 62 further enhance the mixing of the foaming agent and the water. Vanes 62 are positioned on the outside surface of the baffle 60, and are oriented to extend or lie at an angle with respect to a line extending between the point or apex of the inverted cone baffle 60 and the perimeter of the circular base of the inverted cone baffle 60.

A threaded shaft 64, which matingly engages a threaded nut or collar 66, supports baffle 60 within the funnel shaped portion 58. Grasping ridges 68, provided on the flat base of the inverted cone baffle 60, facilitate the turning of the baffle 60. The nut 66 is fixedly supported within the bore of the cylindrical portion 56 by struts 70. Struts 70 resemble the spokes of a wheel and extend radially between cylindrical portion 56 and threaded collar 66. Turning baffle 60 has the effect of screwing shaft 64 into or out of the nut 66, thereby moving cone 60 inward or outward within funnel shaped portion 58. This construction allows the adjustment of the gap between the inverted cone 60 and the funnel shaped portion 58.

Figure 3:
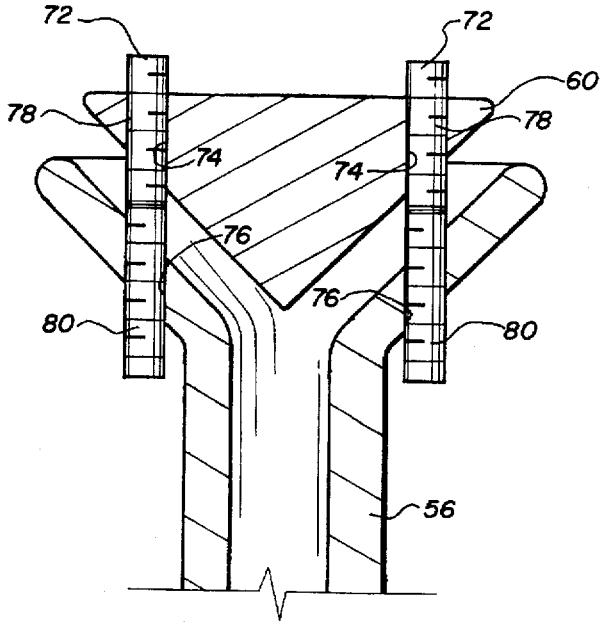
FIG. 3 is a fragmentary cross sectional view showing the foam discharge nozzle of a second embodiment of the present invention.

Referring to FIG. 3 a second embodiment of the present invention is shown. This embodiment differs only with respect to the means used to adjust the gap between the inverted cone 60 and the funnel shaped portion 58. In this embodiment, the threaded shaft 64 is replaced by four identical bolts 72 (only two shogun). Each bolt 72 engages a respective threaded hole 74 in baffle 60 and a respective threaded hole 76 in the wall of the funnel shaped portion 58. Each threaded hole 74 has left handed threads, and each threaded hole 76 has right handed threads. Bolts 72 have left hand threaded upper halves 78 and right hand threaded lower halves 80. Turning bolts 72 counter clockwise moves the baffle 60 up along the bolt 72 while simultaneously unscrewing the bolts 72 out of the holes 76. Thus the gap between baffle 60 and funnel shaped portion 58 is widened by turning bolts 72 counter clockwise. Turning bolts 72 clockwise has the opposite effect, moving the baffle 60 down along the bolt 72 while simultaneously screwing the bolts 72 into the holes 76, thus narrowing the gap between baffle 60 and funnel shaped portion 58. Thus this construction also allows the adjustment of the gap between the inverted cone 60 and the funnel shaped portion 58.

In operation, the nozzle 10 is fixed to the end of the hose 24 using threaded collar 20. When fighting a fire water is supplied under pressure to hose 24. The water passes into barrel 12 and issues at high velocity from the annular gap between lip 30 and the funnel shaped portion 58. Flow rate of water from the nozzle 10 is essentially set by the size of the annular gap between lip 30 and the funnel shaped portion 58. The size of this gap can be controlled by the axial movement of the foam nozzle 14 within the bore of the barrel 12. Because of the tapering outer surface of the funnel shaped portion 58, axial movement of the foam nozzle 14 within the bore of the barrel 12 causes the size of the annular gap between lip 30 and the funnel shaped portion 58 to vary. Axial movement of the foam nozzle 14 within the bore of the barrel 12 is achieved by turning the foam nozzle 14 about its longitudinal axis relative to the barrel 12. The threads 44 in foam nozzle base 40 cause axial displacement of foam nozzle 14 as it is turned, thus allowing the water flow rate through nozzle 10 to be set at the desired level.

Alternatively, spacers in the form of tubes having male threads at one end and female threads at the other, may be inserted between foam nozzle base 40 and foam nozzle 14 to vary the axial position of foam nozzle 14 within the bore of barrel 12.

A relatively small portion of the water supplied to nozzle 10 passes through nozzle 46 creating a jet of water within the foam nozzle base 40. This jet creates a low pressure condition within the base 40, causing foaming agent to be drawn into the base 40 through foaming agent supply line 38 via conduit 36. Suitable foaming agents are well known in the art and are described in U.S. Pat. Nos. 4,497,442 and 4,640,461. The foaming agent is mixed with the water issuing from nozzle 46 and is forced, along with the water issuing from nozzle 46, through the gap between the inverted cone 60 and the funnel shaped portion 58 by the water jet issuing from nozzle 46.

Flow rate of the foaming agent through the nozzle 14 can be adjusted by adjusting the size of the gap between the inverted cone 60 and the funnel shaped portion 58 as was described previously. Mixing of the foaming agent/jet water mixture with the main water stream issuing from the gap between lip 30 and the funnel shaped portion 58 can take place within the flared rim 28 or outside the flared rim 28, depending upon the axial position of the funnel shaped portion 58 along the longitudinal axis 32. The foam mixture issuing from nozzle 10 is then directed at the fire by pointing the discharge end 26 of the nozzle 10 at the fire.

It is to be understood that the present invention is not limited to the embodiments described above, but encompasses any and all embodiments within the scope of the following claims.

We claim:

1. A nozzle assembly for discharging a fire extinguishing mixture, said nozzle assembly comprising:

an outer barrel threadably engageable with a fire hose, said outer barrel having a first inlet end and a first discharge end, said first discharge end having a small diameter end;

a foam discharge nozzle having a portion with a continuously increasing diameter, said portion with a continuously increasing diameter terminating in a second discharge end, said foam discharge nozzle having a second inlet end, said foam discharge nozzle being supported such that said portion with a continuously increasing diameter is in juxtaposition with said small diameter end of said first discharge end, and said foam discharge nozzle having a bore in fluid communication with a foaming agent supply conduit;

a baffle in the shape of an inverted cone movably supported to assume an axial position within said portion with a continuously increasing diameter, said baffle having an outer surface, a gap between said outer surface and said second discharge end defining an opening for discharging a mixture containing a foaming agent, and said gap between said outer surface and said second discharge end having a size which is a function of said axial position of said baffle within said portion with a continuously increasing diameter; and a jet nozzle proximate to said bore in fluid communication with said foaming agent, said jet nozzle creating a low pressure condition within said foam nozzle base and thereby drawing said foaming agent into said foam nozzle base from said foaming agent supply conduit, whereby flow rate of said mixture containing a foaming agent is determined by said size of said gap between said outer surface and said second discharge end.

2. The nozzle assembly according to claim 1, further including:

a threaded collar supported within said bore of said foam discharge nozzle; and a threaded shaft extending from the apex of said baffle, said threaded shaft engaging said threaded collar, thereby allowing said baffle to move axially when said baffle is turned.

3. The nozzle assembly according to claim 2, further including vanes projecting from said outer surface to further enhance mixing of said mixture containing a foaming agent and water passing between said outer barrel and said foam discharge nozzle.

4. The nozzle assembly according to claim 3, further including a foam nozzle base supported within said bore of said outer barrel, said foam nozzle base having a top opening threadably engaging said second inlet end, said foam nozzle base being in fluid communication with said foaming agent supply conduit, and said foam nozzle base having a jet nozzle at the bottom thereof, whereby turning said foam discharge nozzle axially moves said foam discharge nozzle relative to said first discharge end to thereby determine the flow rate of water passing between said outer barrel and said foam discharge nozzle.

5. The nozzle assembly according to claim 1, wherein said baffle has a plurality of threaded holes and said portion with a continuously increasing diameter has a plurality of threaded holes corresponding in number to said plurality of threaded holes in said baffle, said nozzle assembly further including a plurality of bolts corresponding in number to said plurality of threaded holes in said baffle, each of said plurality of bolts having a left hand threaded portion and a right hand threaded portion, said left hand threaded portion of each of said plurality of bolts matingly engaging a respective threaded hole in said baffle, and said right hand threaded portion of each of said plurality of bolts matingly engaging a respective threaded hole in said portion with a continuously increasing diameter, whereby turning said plurality of bolts adjusts said size of said gap between said outer surface and said second discharge end.

6. The nozzle assembly according to claim 5, further including vanes projecting from said outer surface to further enhance mixing of said mixture containing a foaming agent and water passing between said outer barrel and said foam discharge nozzle.

7. The nozzle assembly according to claim 6, further including a foam nozzle base supported within said bore of said outer barrel, said foam nozzle base having a top opening threadably engaging said second inlet end, said foam nozzle base being in fluid communication with said foaming agent supply conduit, and said foam nozzle base having a jet nozzle at the bottom thereof, whereby turning said foam discharge nozzle axially moves said foam discharge nozzle relative to said first discharge end to thereby determine the flow rate of water passing between said outer barrel and said foam discharge nozzle.

8. A nozzle assembly for discharging a fire extinguishing mixture, said nozzle assembly comprising:

an outer barrel threadably engageable with a fire hose, said outer barrel having a first inlet end and a first discharge end, said first discharge end having a small diameter end;

a foam discharge nozzle having a portion with a continuously increasing diameter, said portion with a continuously increasing diameter terminating in a second discharge end, said foam discharge nozzle having a second inlet end, said foam discharge nozzle being supported such that said portion with a continuously increasing diameter is in juxtaposition with said small diameter end of said first discharge end, and said foam discharge nozzle having a bore in fluid communication with a foaming agent supply conduit; and a foam nozzle base supported within said bore of said outer barrel, said foam nozzle base having a top opening threadably engaging said second inlet end, said foam nozzle base being in fluid communication with said foaming agent supply conduit, and said foam nozzle base having a jet nozzle at the bottom thereof, said jet nozzle proximate to said bore in fluid communication with said foaming agent, said jet nozzle creating a low pressure condition within said foam nozzle base and thereby drawing said foaming agent into said foam nozzle base from said foaming agent supply conduit, whereby turning said foam discharge nozzle axially moves said foam discharge nozzle relative to said first discharge end to thereby determine the flow rate of water passing between said outer barrel and said foam discharge nozzle.

* * * * *